US009263780B2

(12) United States Patent
Ono et al.

(10) Patent No.: US 9,263,780 B2
(45) Date of Patent: Feb. 16, 2016

(54) SWITCH MODULE

(71) Applicant: Murata Manufacturing Co., Ltd., Nagaokakyo-shi, Kyoto-fu (JP)

(72) Inventors: Atsushi Ono, Nagaokakyo (JP); Yukiteru Sugaya, Nagaokakyo (JP); Takanori Uejima, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 330 days.

(21) Appl. No.: 13/875,569

(22) Filed: May 2, 2013

(65) Prior Publication Data

US 2013/0300517 A1 Nov. 14, 2013

(30) Foreign Application Priority Data

May 9, 2012 (JP) ..... 2012-107308

(51) Int. Cl.

| | |
|---|---|
| ***H01P 1/10*** | (2006.01) |
| ***H01P 5/16*** | (2006.01) |
| ***H01P 1/12*** | (2006.01) |

(52) U.S. Cl.

CPC *H01P 1/10* (2013.01); *H01P 1/127* (2013.01); *H01P 5/16* (2013.01)

(58) Field of Classification Search

CPC ..... H01P 1/10; H01P 1/127; H01P 5/16
USPC ..... 333/101, 132, 167, 173, 204
See application file for complete search history.

(56) References Cited

U.S. PATENT DOCUMENTS

| | | | | |
|---|---|---|---|---|
| 7,586,388 | B2 * | 9/2009 | Harada | 333/132 |
| 8,803,632 | B2 * | 8/2014 | Takeuchi | 333/101 |
| 2009/0033437 | A1 | 2/2009 | Harada | |
| 2010/0157860 | A1 | 6/2010 | Hagiwara et al. | |
| 2011/0260806 | A1 | 10/2011 | Takeuchi | |

FOREIGN PATENT DOCUMENTS

| | | | |
|---|---|---|---|
| CN | 101479935 | A | 7/2009 |
| CN | 102204100 | A | 9/2011 |
| JP | 2004-253639 | A | 9/2004 |
| JP | 2005-064732 | A | 3/2005 |

(Continued)

OTHER PUBLICATIONS

Official Communication issued in corresponding Japanese Patent Application No. 2012-107308, mailed on Mar. 4, 2014.

*Primary Examiner* — Dean Takaoka
*Assistant Examiner* — Alan Wong
(74) *Attorney, Agent, or Firm* — Keating & Bennett, LLP

(57) ABSTRACT

A switch module includes a multilayer substrate including an antenna terminal, a ground terminal, and a high-frequency-side transmission signal terminal, as external connection terminals. A common-port-side circuit, a switch circuit, and a switching-port-side circuit are provided between the antenna terminal and the high-frequency-side transmission signal terminal. A first wiring portion connects a second inductor that defines a portion of the switching-port-side circuit to the high-frequency-side transmission signal terminal. When the multilayer substrate is viewed in plan, a first inductor, the second inductor, and via electrodes connected to the ground terminal are arranged between the first wiring portion, and second and third wiring portions and a capacitor which are connected to the antenna terminal.

22 Claims, 12 Drawing Sheets

(56) References Cited

FOREIGN PATENT DOCUMENTS

| | | | |
|---|---|---|---|
| JP | 2008-271420 | A | 11/2008 |
| JP | 2009-290897 | A | 12/2009 |
| JP | 2012-054635 | A | 3/2012 |
| WO | WO 2010053131 | A1 * | 5/2010 |

* cited by examiner

SWITCH MODULE

BACKGROUND OF THE INVENTION

1. Field of the Invention

The present invention relates to switch modules that transmit and receive a plurality of communication signals using a common antenna.

2. Description of the Related Art

In recent years, due to multi-band communication in cellular phones and the like, communication apparatuses have reached a level where they can transmit and receive a plurality of signals having different frequencies using a common antenna. Hence, communication apparatuses have increasingly used a switch module that connects a plurality of communication circuits to a common antenna through switching (refer to, for example, Japanese Unexamined Patent Application Publication No. 2008-271420).

FIG. 5A is a block diagram illustrating an example of a general circuit configuration of such a switch module.

Referring to FIG. 5A, a front end circuit FEC includes a switch circuit SW, a common-port-side circuit 104, and switching-port-side circuits 107A to 107H. As external connection terminals, the switch circuit SW also includes an antenna terminal ANT, a power supply terminal Vdd, control terminals Vc1 to Vc4, a low-frequency-side transmission terminal LTx, a high-frequency-side transmission signal terminal HTx, transmission/reception signal terminals TRx1 to TRx6, and a ground terminal GND.

The switch circuit SW includes a common port PIC01 and switching ports PIC11 to PIC18, and is configured to be capable of switching among the switching ports PIC11 to PIC18 so that the switching ports PIC11 to PIC18 may be connected to the common port PIC01. The common-port-side circuit 104 is connected between the antenna terminal ANT and the common port PIC01 of the switch circuit SW. The switching-port-side circuits 107A to 107H are respectively connected between the switching ports PIC11 to PIC18 and the low-frequency-side transmission terminal LTx, the high-frequency-side transmission signal terminal HTx, and the transmission/reception signal terminals TRx1 to TRx6.

In the front end circuit FEC, the common-port-side circuit 104 includes a capacitor which is connected to the antenna as a shunt, a first inductor which is connected in series with the antenna, and a second inductor which is connected to the first inductor as a shunt. The common-port-side circuit 104 is formed as an electrostatic damage protection circuit to prevent intrusion of static electricity from the antenna into the common port PIC01 of the switch circuit SW.

The switching-port-side circuit 107A, which is connected to the low-frequency-side transmission terminal LTx, is formed as a low pass filter that removes the harmonic components of a low-frequency-side transmission signal. The switching-port-side circuit 107B, which is connected to the high-frequency-side transmission signal terminal HTx, is formed as a low pass filter that removes the harmonic components of a high-frequency-side transmission signal.

The front end circuit FEC described above is usually formed as a switch module using a multilayer substrate. The circuit elements of the switch circuit SW, the circuit elements of the common-port-side circuit 104, the circuit elements of the switching-port-side circuits 107A to 107H, and the like are formed using electrode patterns which are formed on the top surface and bottom surface of the multilayer substrate and inside the multilayer substrate and using surface mount components which are surface mounted on the multilayer substrate.

FIG. 5B is a plan view illustrating, using dotted lines, the major portions of electrode patterns within the multilayer substrate of a switching module according to an existing configuration when the multilayer substrate is viewed from the mounting surface side thereof.

A multilayer substrate 111 illustrated in FIG. 5B, which defines the front end circuit FEC described above, includes external connection terminals provided on the mounting surface with which the multilayer substrate 111 is to be mounted on an external substrate. The multilayer substrate 111 includes a plurality of via electrodes (not illustrated) and pattern electrodes provided within the substrate.

In the multilayer substrate 111, the antenna terminal ANT and the high-frequency-side transmission signal terminal HTx are arranged next to each other with the ground terminal GND therebetween. A pattern electrode 112 that is connected to the antenna terminal ANT and forms part of a capacitor is arranged close to an electrode pattern 113 that is connected to the high-frequency-side transmission signal terminal HTx and forms a lead wiring line.

In recent years, external connection terminal patterns have become very fine due to a reduction in the size of switching modules and, hence, the antenna terminal ANT and the high-frequency-side transmission signal terminal HTx are arranged close to each other in an increasing number of cases. As a result, there have been cases in which the circuit elements and lead wiring line of the common-port-side circuit are arranged close to, and are coupled through an electromagnetic field to, the lead wiring lines of the switching-port-side circuits, whereby the isolation characteristics of the switch module are degraded.

In particular, when the capacitor of the common-port-side circuit is capacitively coupled to the lead wiring lines of the low pass filters of the switching-port-side circuits, attenuation in the attenuation bands of the low pass filters becomes small, whereby the amounts of removed harmonic components become small.

SUMMARY OF THE INVENTION

Preferred embodiments of the present invention provide a switch module that significantly reduce or prevent electromagnetic field coupling generated between the lead wiring line of a common-port-side circuit and switching-port-side circuits.

According to a preferred embodiment of the present invention, a switch module includes a multilayer substrate, a switch circuit, a common-port-side circuit, and a plurality of switching-port-side circuits. The multilayer substrate is defined by stacking a plurality of dielectric layers and includes a plurality of external connection terminals arranged on an outer surface of the multilayer substrate. The switch circuit includes a common port and a plurality of switching ports, and is arranged to switch the switching port so that the switching port becomes connected to the common port. The common-port-side circuit is connected between the common port of the switch circuit and a first external connection terminal among the plurality of the external connection terminals. A first switching-port-side circuit includes a filter circuit and is connected between one of the plurality of the switching ports and a second external connection terminal among the plurality of the external connection terminals.

Further, the switch module according to a preferred embodiment of the present invention includes a first wiring portion that connects the filter circuit to the second external connection terminal, and a second wiring portion that is arranged between the first wiring portion and the common-port-side circuit when the multilayer substrate is viewed in plan and that significantly reduces or prevents electromagnetic field coupling between the first wiring portion and the common-port-side circuit.

With this configuration, since the common-port-side circuit and the first wiring portion between the filter circuit and the external connection terminal are arranged so as to be spaced apart from each other with the second wiring portion therebetween, electromagnetic field coupling therebetween is significantly reduced such that isolation of the common-port-side circuit and the first switching-port-side circuit from each other is improved and the attenuation characteristics of the filter circuit are improved.

In the switch module described above, the second wiring portion may include a pattern electrode and a via electrode defining, together with the first wiring portion, the first switching-port-side circuit.

With this configuration, even when the second wiring portion and the common-port-side circuit are coupled to each other through an electromagnetic field, the first wiring portion in the output stage of the filter circuit is prevented from being influenced by the electromagnetic field coupling, by the filter circuit defining the first switching-port-side circuit.

In the switch module described above, the second wiring portion may include a pattern electrode and a via electrode connected to a ground potential.

In the switch module described above, the common-port-side circuit may include a capacitor connected to the first external connection terminal as a shunt, a first inductor connected in series with the first external connection terminal, and a second inductor connected to the first inductor as a shunt.

In the switch module described above, the common-port-side circuit preferably includes a pattern electrode that is arranged between the common port and the first external connection terminal so as to face a ground electrode and functions as a portion of the capacitor.

In the switch module described above, the common-port-side circuit preferably includes a pattern electrode defining and functioning as the first inductor, between the common port and the first external connection terminal.

With these configurations, since wiring between the common port and the first external connection terminal functions as circuit elements that define the common-port-side circuit, an area occupied by the circuit elements that define the common-port-side circuit is decreased and, hence, the module size is decreased.

The switch module described above may further include a non-grounded pattern electrode that faces a ground electrode arranged on an inner layer of the multilayer substrate and that defines a portion of the capacitor.

In the switch module described above, the pattern electrode forming portion of the capacitor is preferably arranged on a dielectric layer different from a dielectric layer on which the filter circuit is arranged.

With this configuration, since the non-grounded capacitor defining the capacitor with the ground electrode and the filter circuit can be arranged so as to be spaced apart from each other in the stacking direction of the multilayer substrate, electromagnetic field coupling between the capacitor and the filter circuit is significantly reduced or prevented.

In the switch module described above, the pattern electrode defining a portion of the capacitor is preferably surrounded by via electrodes connected to a ground potential.

With this configuration, since the non-grounded pattern electrode is surrounded by via electrodes connected to the ground potential, the electromagnetic field coupling between the capacitor and the filter circuit is further reduced or prevented.

In the switch module described above, ground electrodes are preferably arranged on both sides, in the stacking direction of the multilayer substrate, of the pattern electrode defining a portion of the capacitor.

With this configuration, even when the filter circuit is arranged on either of the two sides of the multilayer substrate in the stacking direction, the electromagnetic field coupling between the capacitor and the filter circuit is significantly reduced or prevented.

According to preferred embodiments of the present invention, by arranging a second wiring portion between a common-port-side circuit and a first wiring portion in the output stage of a filter circuit defining a switching-port-side circuit, electromagnetic field coupling between the first wiring portion and the common-port-side circuit is significantly reduced or prevented. As a result, isolation of the common-port-side circuit and the first switching-port-side circuit from each other is improved and the attenuation characteristics of the filter circuit are improved.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Hereinafter, a switching module according to a first preferred embodiment of the present invention will be described with reference to FIG. 1A to FIG. 1D.

Figure 5A:
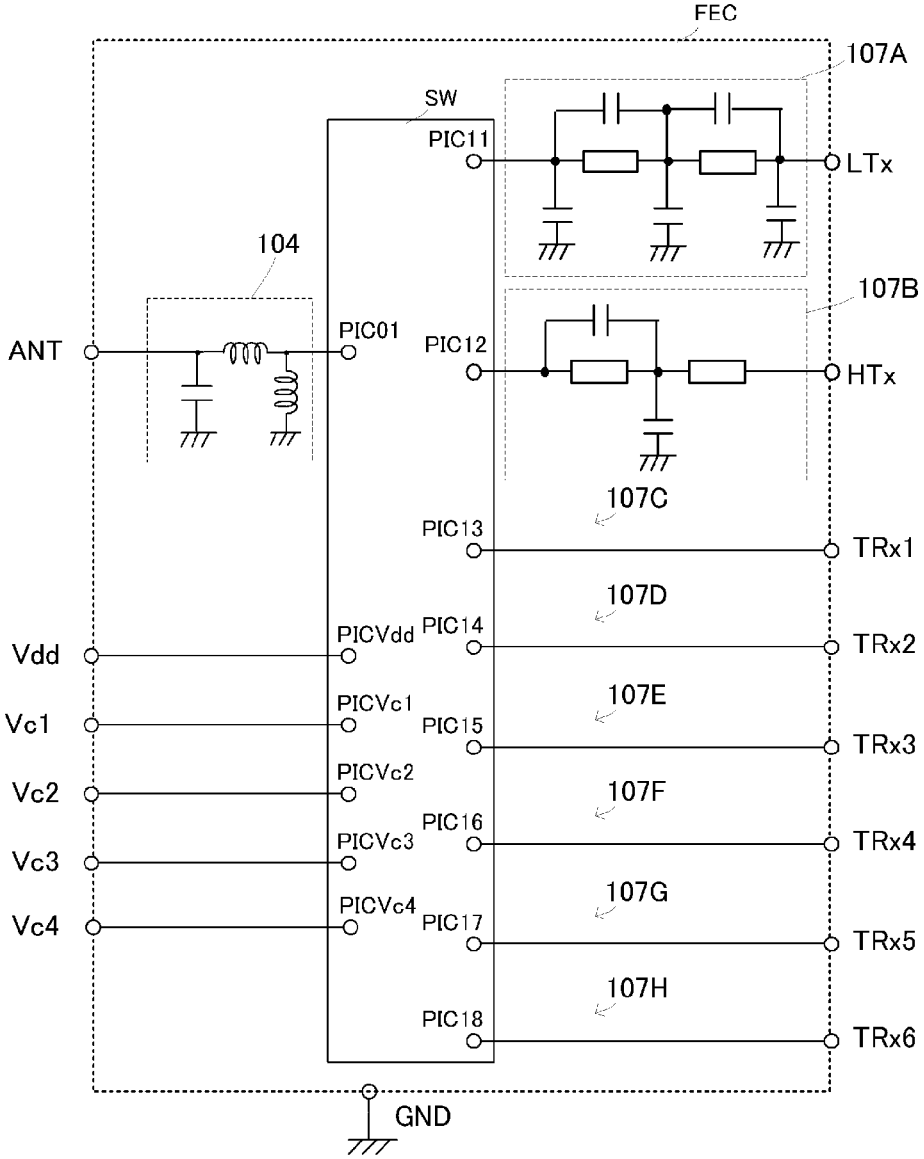
FIG. 5A Prior Art
FIG. 5A is a block diagram illustrating a general circuit configuration of a switch module.

The circuit configuration of the switch module according to the present preferred embodiment is preferably the same as that of the front end circuit FEC illustrated in FIG. 5A. Hence, here, the detailed description of the entirety of the circuit will be omitted and the configurations of the common-port-side circuit connected to the antenna terminal ANT and the switching-port-side circuit connected to the high-frequency-side transmission signal terminal HTx will be described in detail.

Figure 1A:
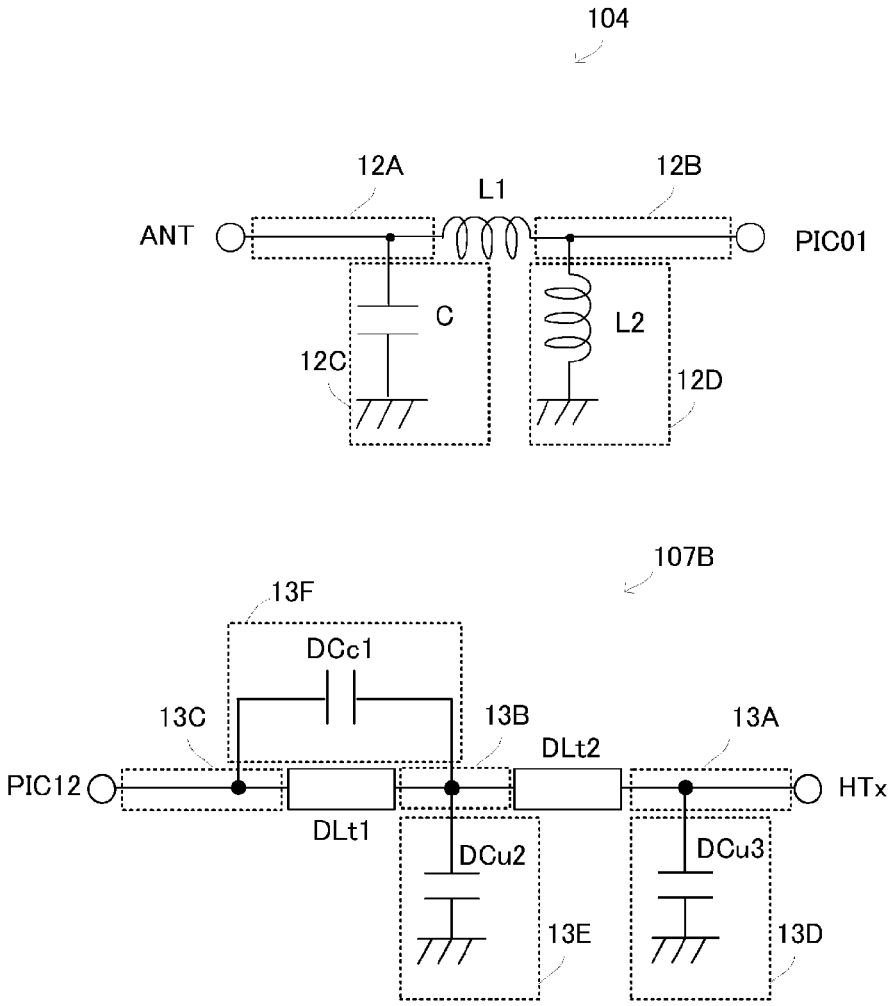
FIG. 1A is a block diagram illustrating the circuit configuration of a switch module according to a first preferred embodiment of the present invention.

The common-port-side circuit 104 illustrated in FIG. 1A is preferably connected between the antenna terminal ANT and the common port PIC01 of the switch circuit SW. The common-port-side circuit 104 preferably includes a capacitor C, a first inductor L1, and a second inductor L2 as circuit elements. The common-port-side circuit 104 includes wiring portions 12A to 12D as wiring portions. A first end of the inductor L1 is connected to the antenna terminal ANT through the wiring portion 12A. The second end of the inductor L1 is connected to the common port PIC01 through the wiring portion 12B. The wiring portion 12C branches from the wiring portion 12A and is connected to the ground through the capacitor C. The wiring portion 12D branches from the wiring portion 12B and is connected to the ground through the inductor L2.

The switching-port-side circuit 107B illustrated in FIG. 1A is preferably connected between the high-frequency-side transmission signal terminal HTx and the switching port PIC12 of the switch circuit SW. The switching-port-side circuit 107B preferably includes inductors DLt1 and DLt2 and capacitors DCc1, DCu2, and DCu3 as circuit elements. The switching-port-side circuit 107B includes wiring portions 13A to 13F as wiring portions. A first end of the inductor DLt2 is preferably connected to the high-frequency-side transmission signal terminal HTx through the wiring portion 13A. The second end of the inductor DLt2 is preferably connected to a first end of the inductor DLt1 through the wiring portion 13B. The second end of the inductor DLt1 is preferably connected to the switching port PIC12 through the wiring portion 13C. The wiring portion 13D branches from the wiring portion 13A and is preferably grounded through the capacitor DCu3. The wiring portion 13E branches from the wiring portion 13B and is preferably grounded through the capacitor DCu2. The wiring portion 13F branches from the wiring portion 13C and is preferably connected to the capacitor DCu2 through the capacitor DCc1.

Figure 1B:
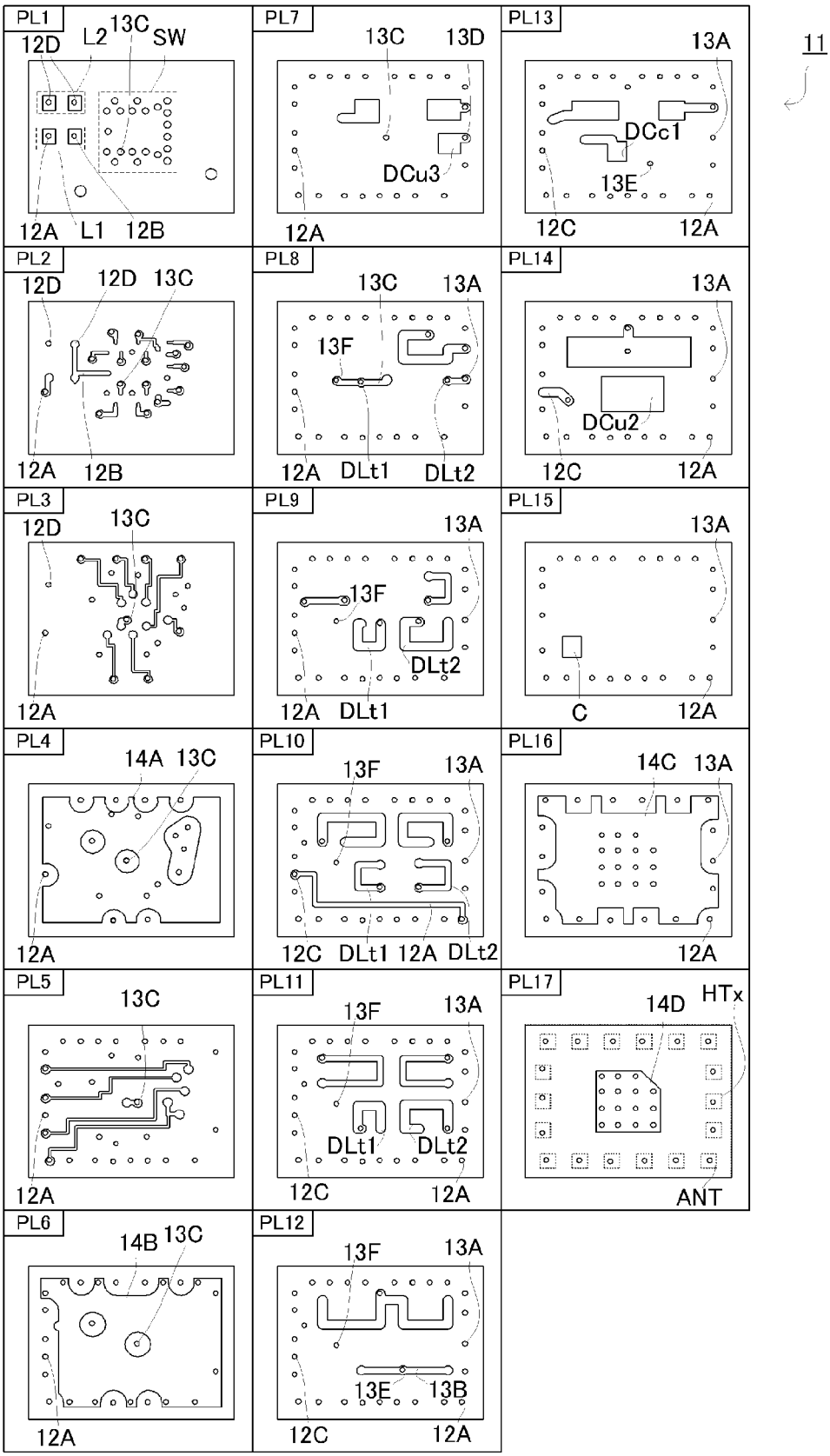
FIG. 1B is a stacking diagram of a multilayer substrate which defines the switch module according to the first preferred embodiment of the present invention.

FIG. 1B is a stacking diagram of a multilayer substrate 11 which defines the switching module according to the first preferred embodiment. Here, the multilayer substrate 11 is defined by stacking 17 ceramic layers (i.e., dielectric layers). Predetermined electrode patterns are arranged on the upper surface of the dielectric layers and via electrodes for interlayer connections are provided within the dielectric layers. The via electrodes are illustrated in the figure as small circles. In the descriptions below, it is assumed that the 17 dielectric layers are sequentially denoted by PL1 to PL17 from the uppermost dielectric layer (P11) to the lowermost dielectric layer (PL17).

On the top surface of the dielectric layer PL1, which is the uppermost layer, a plurality of device mounting electrodes are provided. A plurality of chip devices are mounted on the device mounting electrodes. The chip devices used in the present preferred embodiment preferably are the switch circuit SW and the inductors L1 and L2.

The dielectric layers PL2 and PL3, which are the second and third layers of the multilayer substrate 11, include a plurality of electrode patterns provided thereon and via electrodes arranged therein. These electrode patterns are used for the wiring of the device mounting electrodes. The dielectric layer PL4, which is the fourth layer of the multilayer substrate 11, preferably includes an inner-layer ground electrode 14A arranged thereon and a plurality of via electrodes provided therein. The inner-layer ground electrode 14A has a function of preventing generation of electromagnetic field coupling between the wiring of the dielectric layer PL5 and the wiring of the dielectric layers PL2 and PL3. The dielectric layer PL5, which is the fifth layer of the multilayer substrate 11, includes a plurality of pattern electrodes arranged thereon and a plurality of via electrodes provided therein. These pattern electrodes are also used for wiring. The dielectric layer PL6, which is the sixth layer of the multilayer substrate 11, includes an inner-layer ground electrode 14B arranged thereon and a plurality of via electrodes provided therein. The inner-layer ground electrode 14B has a function of preventing generation of electromagnetic field coupling between the wiring of the dielectric layer PL5 and the electrodes of the dielectric layers PL7 to PL15.

The dielectric layer PL7, which is the seventh layer of the multilayer substrate 11, includes a pattern electrode arranged thereon which defines a portion of a capacitor and via electrodes provided therein. The dielectric layers PL8 to PL12, which are the eighth to twelfth layers of the multilayer substrate 11, include pattern electrodes arranged thereon which define inductors, pattern electrodes arranged thereon which define wiring, and via electrodes provided therein. The dielectric layers PL13 to PL15, which are the 13th to 15th layers of the multilayer substrate 11, include electrode patterns arranged thereon which define capacitors and via electrodes provided therein.

The dielectric layer PL16, which is the 16th layer of the multilayer substrate 11, includes inner-layer ground electrode 14C arranged thereon and a plurality via electrodes provided therein. The inner-layer ground electrode 14C has a function of preventing generation of electromagnetic field coupling between the electrodes of the dielectric layers PL7 to PL15 and external connection terminals. The dielectric layer PL17, which is the 17th layer of the multilayer substrate 11, preferably includes an external ground electrode 14D arranged thereon, a plurality of via electrodes provided therein, and a plurality of the external connection electrodes arranged thereon. The external ground electrode 14D is provided to electrically connect the inner-layer ground electrodes 14A to 14C to the ground electrode of another substrate on which the multilayer substrate 11 is to be mounted.

The above-described wiring portion 12A between the antenna terminal ANT and the inductor L1 extends from a position at which the wiring portion 12A is connected to the inductor L1 and is connected to the antenna terminal ANT, through via electrodes provided in the dielectric layers PL1 to PL9, the pattern electrodes provided on the dielectric layers PL2 and PL10, and the via electrodes provided in the dielectric layers PL10 to PL17. The pattern electrode that is provided on the dielectric layer PL10 and which defines a portion of the wiring portion 12A extends from a position near the side surface of the multilayer substrate 11 on the left hand side in the figure to a position near the side surface of the multilayer substrate 11 on the right hand side in the figure.

The wiring portion 12C that branches from the wiring portion 12A is defined by the via electrodes provided in the dielectric layers PL10 to PL14 and the pattern electrode provided on the dielectric layer PL14. The capacitor C connected to the wiring portion 12C is preferably defined by a non-grounded pattern electrode provided on the dielectric layer PL15 and the inner-layer ground electrode 14C provided on the dielectric layer PL16.

The wiring portion 12B between the inductor L1 and the switch circuit SW extends from a position at which the wiring portion 12B is connected to the inductor L1, which is a chip device, and is connected to the switch circuit SW through the via electrode provided in the dielectric layer PL1 and the pattern electrode provided on the dielectric layer PL2. The wiring portion 12D which branches from the wiring portion 12B is preferably defined by the via electrodes provided in the dielectric layers PL1 to PL3 and the pattern electrode provided on the dielectric layer PL2. The inductor L2 connected to the wiring portion 12D is preferably a chip device.

The wiring portion 13A between the high-frequency-side transmission signal terminal HTx and the inductor DLt2 is defined by via electrodes provided in the dielectric layers PL8 to PL17 and the pattern electrode provided on the dielectric layer PL8. The inductor DLt2 is defined by the via electrodes provided in the dielectric layers PL8 to PL11 and the pattern electrodes provided on the dielectric layers PL9 to PL11. The wiring portion 13B connected between the inductor DLt2 and the inductor DLt1 is defined by the pattern electrode provided on the dielectric layer PL12. The inductor DLt1 is defined by the via electrodes provided in the dielectric layers PL8 to PL11 and the pattern electrodes provided on the dielectric layers PL9 to PL11. The wiring portion 13C between the inductor DLt1 and the switch circuit SW is defined by via electrodes provided in the dielectric layers PL1 to PL7 and the pattern electrodes provided on the dielectric layers PL2, PL3, PL5, and PL8.

The wiring portion 13D which branches from the wiring portion 13A is defined by the via electrode provided in the dielectric layer PL7. The capacitor DCu3 connected to the wiring portion 13D is defined by the pattern electrode provided on the dielectric layer PL7 and the inner-layer ground electrode 14B provided on the dielectric layer PL6.

The wiring portion 13E which branches from the wiring portion 13B is defined by the via electrodes provided on the dielectric layers PL12 and PL13. The capacitor DCu2 connected to the wiring portion 13E is defined by the pattern electrode provided on the dielectric layer PL14 and the inner-layer ground electrode 14C provided on the dielectric layer PL16.

The wiring portion 13F which branches from the wiring portion 13C is defined by the pattern electrode provide on the dielectric layer PL8 and the via electrodes provided in the dielectric layers PL8 to PL12. The capacitor DCc1 connected to the wiring portion 13C is defined by the pattern electrode provided on the dielectric layer PL13 and the pattern electrode provided on the dielectric layer PL14.

Figure 1C:
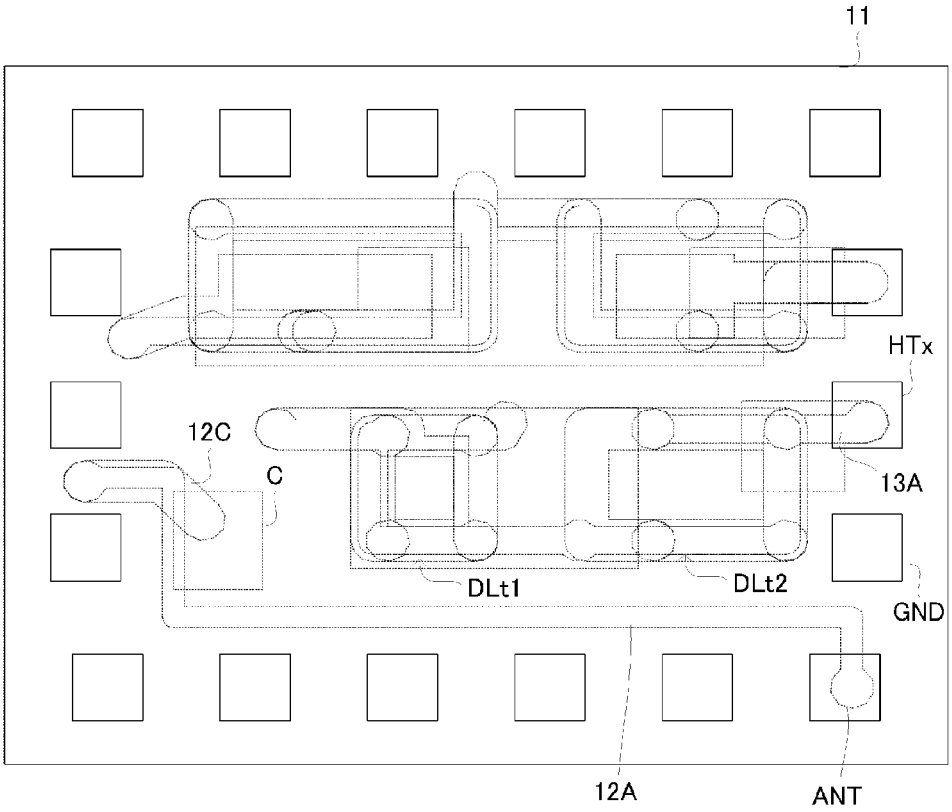
FIG. 1C is a plan view of the mounting surface of the multilayer substrate which defines the switch module according to the first preferred embodiment of the present invention.

FIG. 1C is a plan view of the multilayer substrate 11 viewed from the bottom surface side, illustrated as a mirror image in which left and right are reversed. FIG. 1C illustrates a transparent view of the pattern electrodes on the dielectric layers PL7 to PL15 sandwiched between the inner-layer ground electrodes 14B and 14C.

The wiring portion 13A between the inductor DLt2 and the high-frequency-side transmission signal terminal HTx is a first wiring portion in the present preferred embodiment. The wiring portion 13A, when coupled to the wiring portion 12A, the wiring portion 12C, or the capacitor C connected to the antenna terminal ANT through an electromagnetic field, causes degradation of the isolation characteristics and the filter characteristics.

Hence, in the multilayer substrate 11 in the switch module of the present preferred embodiment, via electrodes (not illustrated) connected to the ground terminal GND and the inductors DLt1 and DLt2 are arranged between the wiring portion 13A and the wiring portions 12A and 12C and between the wiring portion 13A and the capacitor C, in the transparent plan view of the dielectric layers PL8 to PL17 where the wiring portion 13A is provided. These via electrodes and the inductors DLt1 and DLt2 correspond to a second wiring portion in the present preferred embodiment, and allow the wiring portion 13A to be electromagnetically separated from the common-port-side circuit.

Note that since the pattern electrode which defines a portion of the capacitor C is close to the inductor DLt1, the pattern electrode and the inductor DLt1 may be coupled to each other through an electromagnetic field. However, since the inductor DLt1 is a circuit element defining the input stage of a low pass filter circuit, an influence from the coupling with the capacitor C is removed by the low pass filter circuit and, hence, the wiring portion 13A is not influenced by the coupling.

As a result, electromagnetic field coupling between the wiring portion 13A and the common-port-side circuit is reduced, whereby isolation of the common-port-side circuit 104 and the switching-port-side circuit 107B from each other is improved and the attenuation characteristics of the low pass filter defining the switching-port-side circuit 107B are improved.

In the present preferred embodiment, the capacitor C is preferably defined by the non-grounded pattern electrode provided on the dielectric layer PL15 and the inner-layer ground electrode 14C arranged on the dielectric layer PL16. The non-grounded pattern electrode that defines a portion of the capacitor C is provided on the dielectric layer PL15, which is different from the dielectric layers PL7 to PL14 where the inductors DLt1 and DLt2, the capacitors DCc1, DCu2, and DCu3, the pattern electrodes of wiring, and the like are provided. Hence, the capacitor C is arranged so as to be spaced apart from the filter circuit in the stacking direction of the multilayer substrate 11, whereby electromagnetic field coupling between the capacitor C and the filter circuit is significantly reduced or prevented.

Figure 1D:
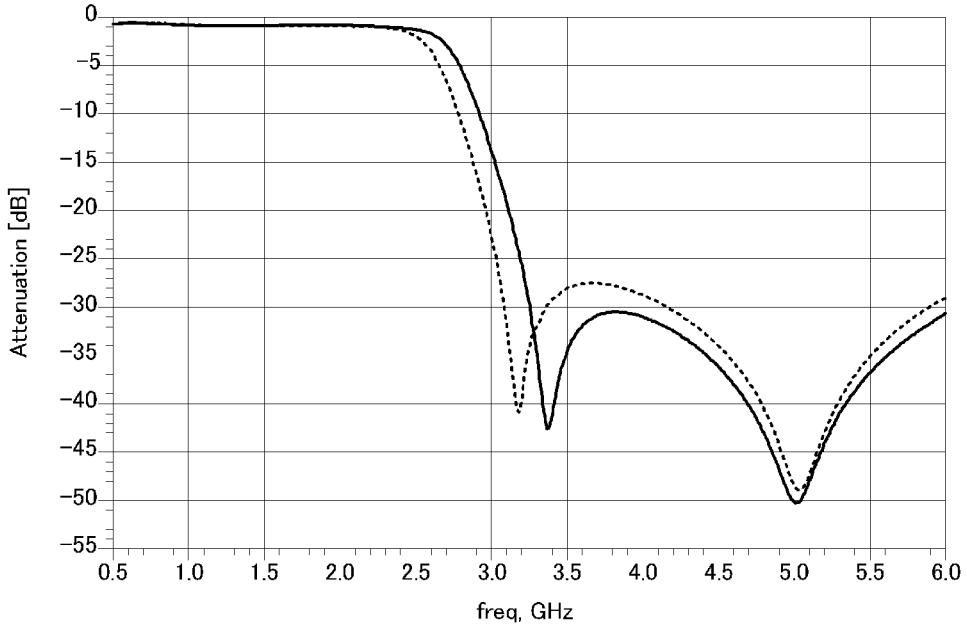
FIG. 1D is a characteristics diagram of the switch module according to the first preferred embodiment of the present invention.
Figure 5B:
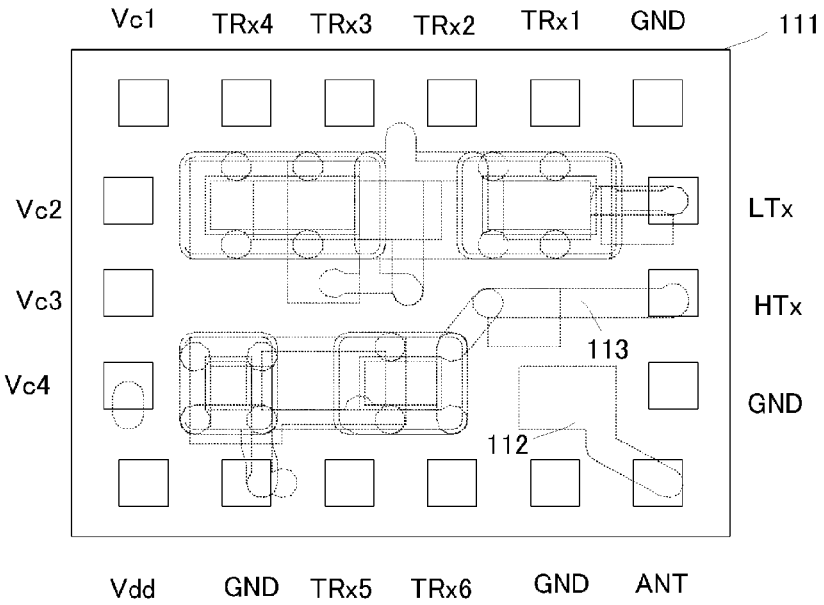
FIG. 5B Prior Art
FIG. 5B is a plan view of the mounting surface of an existing multilayer substrate which defines the switch module.

FIG. 1D is a characteristics diagram illustrating the attenuation characteristics of the low pass filter which defines the switching-port-side circuit 107B in the present preferred embodiment. In the figure, the attenuation characteristics according to the present preferred embodiment are illustrated using a solid line, and the attenuation characteristics according to the existing configuration illustrated in FIG. 5B are illustrated using a dotted line. As illustrated in FIG. 1D, regarding the attenuation characteristics according to the present preferred embodiment, higher attenuation and better attenuation characteristics than in the existing configuration are realized.

Second Preferred Embodiment

Hereinafter, a switch module according to a second preferred embodiment of the present invention will be described.

Note that the circuit configuration of the switch module according to the present preferred embodiment is also preferably the same as that of the front end circuit FEC illustrated in FIG. 5A.

Figure 2A:
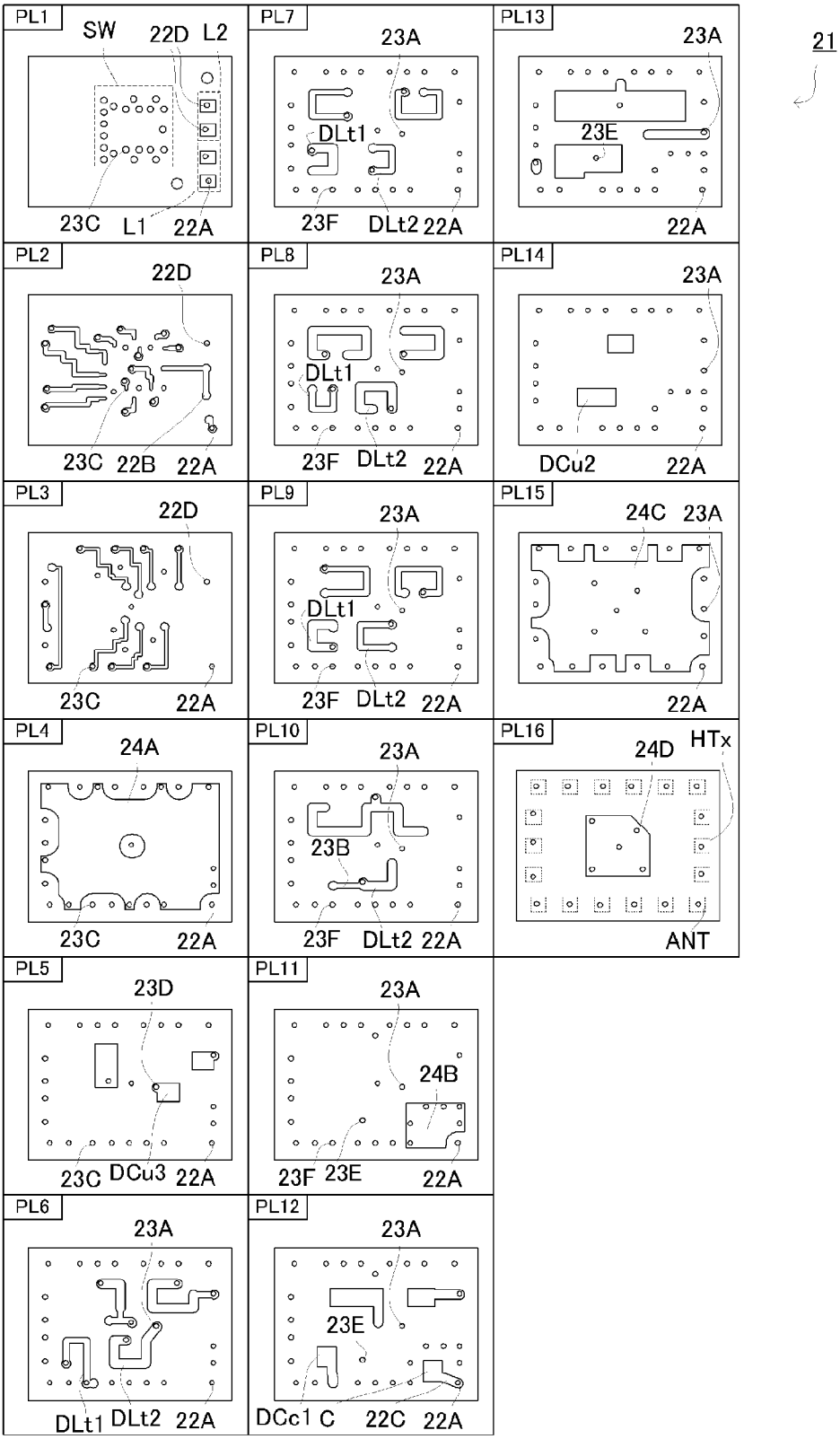
FIG. 2A is a stacking diagram of a multilayer substrate which defines a switch module according to a second preferred embodiment of the present invention.

FIG. 2A is stacking diagram of a multilayer substrate 21 of the switch module according to the second preferred embodiment. Here, the multilayer substrate 21 is preferably defined by stacking 16 ceramic layers (dielectric layers). In the descriptions below, it is assumed that the 16 dielectric layers are sequentially denoted by PL1 to PL16 from the uppermost dielectric layer (P11) to the lowermost dielectric layer (PL16).

On the top surface of the dielectric layer PL1, which is the uppermost layer, a plurality of device mounting electrodes are arranged. A plurality of chip devices are mounted on the device mounting electrodes. The chip devices used in the present preferred embodiment are preferably the switch circuit SW and the inductors L1 and L2.

The dielectric layers PL2 and PL3, which are the second and third layers of the multilayer substrate 21, include a plurality of electrode patterns arranged thereon and via electrodes provided therein. These electrode patterns are used in the wiring of the device mounting electrodes. The dielectric layer PL4, which is the fourth layer of the multilayer substrate 21, includes an inner-layer ground electrode 24A arranged thereon and a plurality of via electrodes provided therein. The inner-layer ground electrode 24A has a function of preventing generation of electromagnetic field coupling between the wiring of the dielectric layers PL5 to PL14 and the wiring of the dielectric layers PL2 and PL3.

The dielectric layer PL5, which is the fifth layer of the multilayer substrate 21, includes a pattern electrode arranged thereon which defines a portion of a capacitor and via electrodes provided therein. The dielectric layers PL6 to PL10, which are the sixth to the tenth layers of the multilayer substrate 21, include pattern electrodes arranged thereon which define inductors, pattern electrodes arranged thereon which define wiring, and via electrodes provided therein. The dielectric layer PL11, which is the 11th layer of the multilayer substrate 21, preferably includes an inner-layer ground electrode 24B arranged thereon and a plurality of via electrodes provided therein. The inner-layer ground electrode 24B is arranged on the top surface of the dielectric layer PL11 in a rectangular or substantially rectangular shape and is surrounded by via electrodes connected to the ground potential. The dielectric layers PL11 to PL14, which are the 11th to 14th layers of the multilayer substrate 21, include pattern electrodes arranged thereon which define capacitors and via electrodes provided therein. The dielectric layer PL15, which is the 15th layer of the multilayer substrate 21, preferably includes an inner-layer ground electrode 24C arranged thereon and a plurality of via electrodes provided therein. The inner-layer ground electrode 24C preferably has a function of preventing generation of electromagnetic field coupling between the electrodes of the dielectric layers PL5 to PL14 and external connection terminals. The dielectric layer PL16, which is the 16th layer of the multilayer substrate 21, preferably includes an external ground electrode 24D arranged thereon, a plurality of via electrodes provided therein, and a plurality of the external connection terminals provided thereon. The external ground electrode 24D is provided to electrically connect the inner-layer ground electrodes 24A to 24C to the ground electrode of another substrate on which the multilayer substrate 21 is to be mounted.

A wiring portion 22A between the antenna terminal ANT and the inductor L1 is preferably defined by via electrodes provided in the dielectric layers PL1 to PL16 and a pattern electrode provided on the dielectric layer PL2.

A wiring portion 22C which branches from the wiring portion 22A is preferably defined by a pattern electrode provided on the dielectric layer PL12. The capacitor C connected to the wiring portion 22C is preferably defined by a pattern electrode provided on the dielectric layer PL12 and the inner-layer ground electrode 24B provided on the dielectric layer PL11. The inductor L1 connected to the wiring portion 22A is preferably a chip device.

A wiring portion 22B between the inductor L1 and the switch circuit SW is preferably defined by the via electrode provided in the dielectric layer PL1 and the pattern electrode provided on the dielectric layer PL2. A wiring portion 22D which branches from the wiring portion 22B is preferably defined by the via electrodes provided in the dielectric layers PL1 to PL3. The inductor L2 connected to the wiring portion 22D preferably is a chip device.

A wiring portion 23A between the high-frequency-side transmission signal terminal HTx and the inductor DLt2 is preferably defined by the via electrodes provided in the dielectric layers PL6 to PL12, the pattern electrode provided on the dielectric layer PL13, and the via electrodes provided in the dielectric layers PL13 to PL16. The inductor DLt2 connected to the wiring portion 23A is preferably defined by the via electrodes provided in the dielectric layers PL6 to PL10 and the pattern electrodes provided on the dielectric layers PL6 to PL10. A wiring portion 23B between the inductor DLt2 and the inductor DLt1 is defined by the pattern electrode provided on the dielectric layer PL10. The inductor DLt1 connected to the wiring portion 23B is preferably defined by the via electrodes provided in the dielectric layers PL6 to PL9 and the pattern electrodes provided on the dielectric layers PL6 to PL9. A wiring portion 23C between the inductor DLt1 and the switch circuit SW is preferably defined by the via electrodes provided in the dielectric layers PL1 to PL5 and the pattern electrodes provided on the dielectric layers PL2 and PL3.

A wiring portion 23D which branches from the wiring portion 23A is preferably defined by the via electrode provided in the dielectric layer PL5. The capacitor DCu3 connected to the wiring portion 23D is preferably defined by the pattern electrode provided on the dielectric layer PL5 and an inner-layer ground electrode 24A provided on the dielectric layer PL4.

A wiring portion 23E which branches from the wiring portion 23B is preferably defined by the via electrodes provided in the dielectric layer PL10 to PL13. The capacitor DCu2 connected to the wiring portion 23E is defined by the pattern electrode provided on the dielectric layer PL14 and the inner-layer ground electrode 24C provided on the dielectric layer PL15.

A wiring portion 23F which branches from the wiring portion 23C is preferably defined by the via electrodes provided in the dielectric layers PL6 to PL11. The capacitor DCc1 connected to the wiring portion 23F is preferably defined by the pattern electrode provided on the dielectric layer PL12 and the pattern electrode provided on the dielectric layer PL13.

Figure 2B:
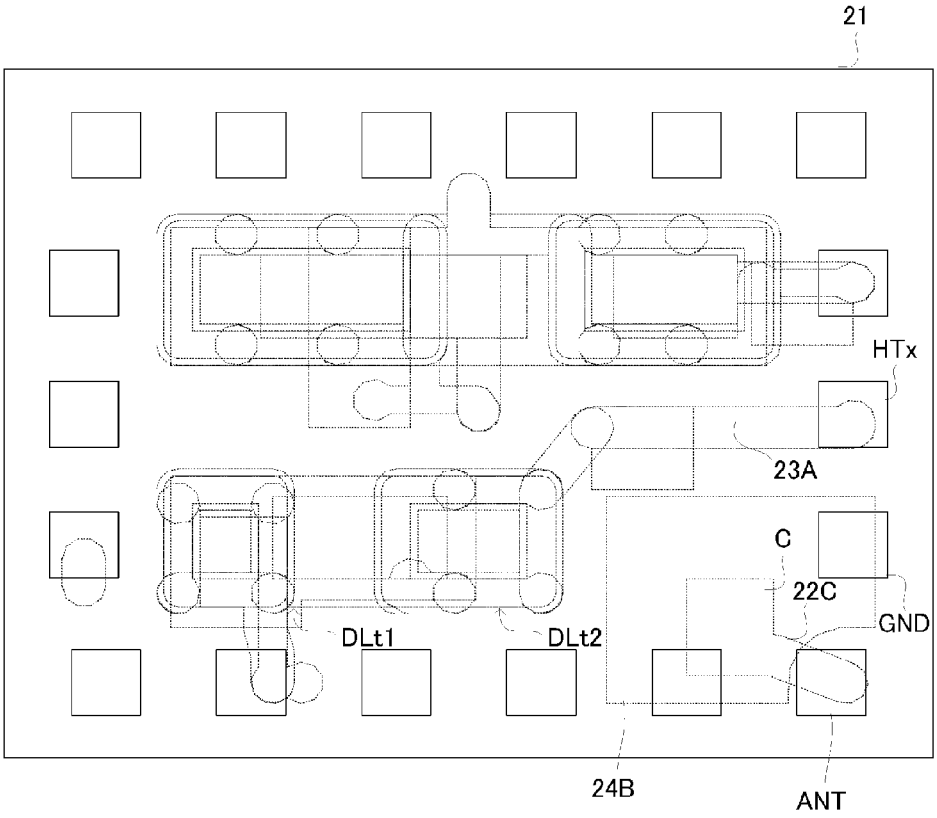
FIG. 2B is a plan view of the mounting surface of the multilayer substrate which defines the switch module according to the second preferred embodiment of the present invention.

FIG. 2B is a plan view of the multilayer substrate 21 viewed from the bottom surface side, illustrated as a mirror image in which left and right are reversed. FIG. 2B illustrates a transparent view of the pattern electrodes on the dielectric layers PL5 to PL14 sandwiched between the inner-layer ground electrodes 24A and 24C.

The wiring portion 23A between the inductor DLt2 and the high-frequency-side transmission signal terminal HTx is a first wiring portion in the present preferred embodiment. The wiring portion 23A, when coupled to the wiring portion 22A, the wiring portion 22C, or the capacitor C connected to the antenna terminal ANT through an electromagnetic field, causes degradation of the isolation characteristics and the filter characteristics.

Hence, in the multilayer substrate 21 in the switch module of the present preferred embodiment, via electrodes (not illustrated) connected to the ground terminal GND and also to the inner-layer ground electrode 24B are arranged between the wiring portion 23A and the wiring portions 22A and 22C and between the wiring portion 23A and the capacitor C, in the transparent plan view of the dielectric layers PL6 to PL16 where the wiring portion 23A is arranged. These via electrodes correspond to a second wiring portion in the present preferred embodiment, and allow the wiring portion 23A to be electromagnetically separated from the common-port-side circuit. Since electromagnetic field coupling between the wiring portion 23A and the common-port-side circuit is reduced, isolation of the common-port-side circuit 104 and the switching-port-side circuit 107B from each other is improved and the attenuation characteristics of the low pass filter defining the switching-port-side circuit 107B are improved.

Third Preferred Embodiment

Hereinafter, a switch module according to a third preferred embodiment of the present invention will be described.

Note that the circuit configuration of the switch module according to the present preferred embodiment is also preferably the same as that of the front end circuit FEC illustrated in FIG. 5A.

Figure 3A:
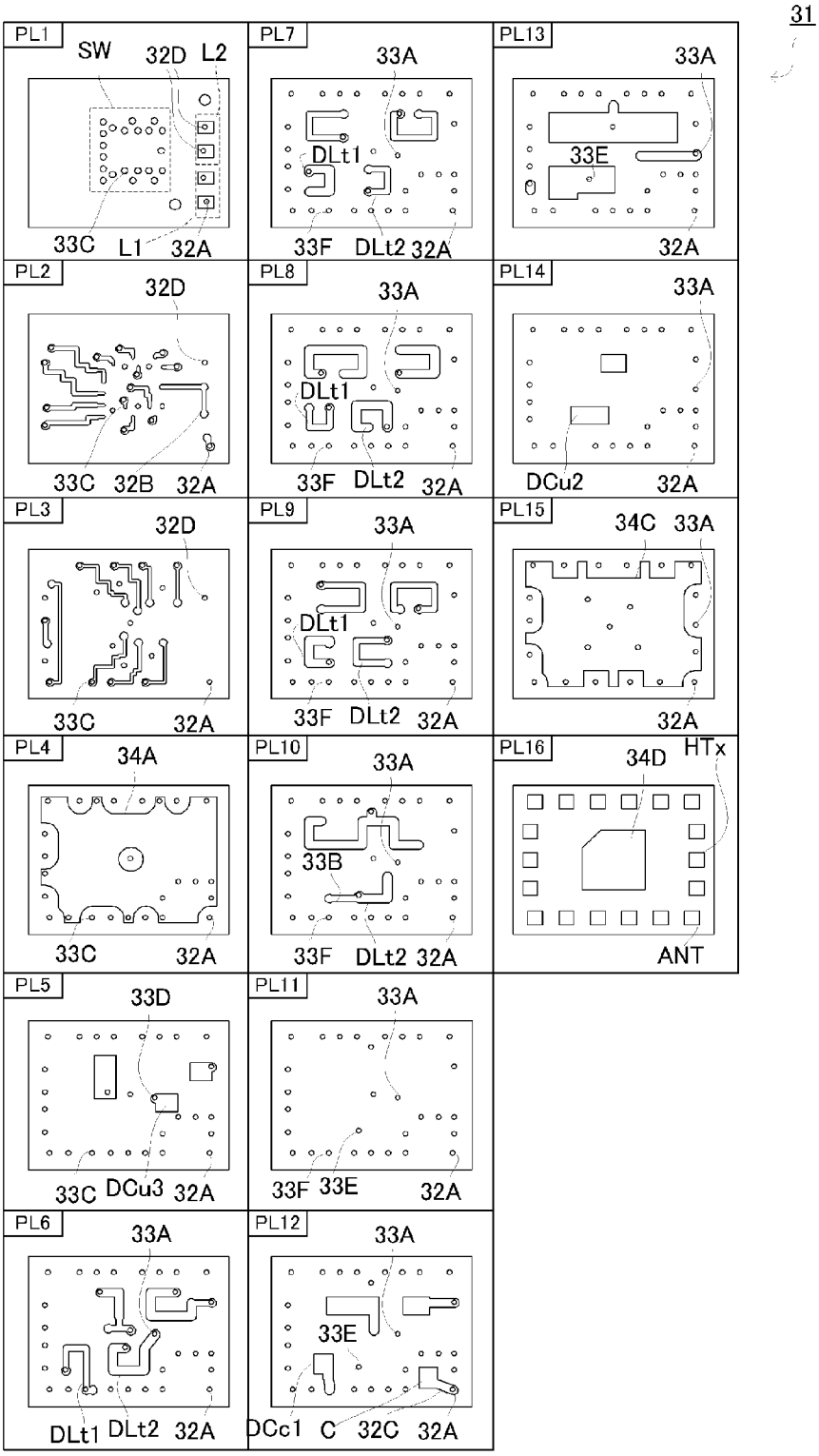
FIG. 3A is a stacking diagram of a multilayer substrate which defines a switch module according to a third preferred embodiment of the present invention.

FIG. 3A is a stacking diagram of a multilayer substrate 31 of the switch module according to the third preferred embodiment. Note that the multilayer substrate 31 is preferably defined by removing the inner-layer ground electrode 24B from the multilayer substrate 21 described in the second preferred embodiment and by defining the capacitor C using a pattern electrode provided in the dielectric layer PL12 and an inner-layer ground electrode 34C provided on the dielectric layer PL16. A plurality of via electrodes connected to an inner-layer ground electrode 34A of the dielectric layer PL4 and the inner-layer ground electrode 34C of the dielectric layer PL16 are preferably arranged so as to surround the capacitor C. The rest of the configuration of the multilayer substrate 31 is preferably the same as that of the multilayer substrate 21 described in the second preferred embodiment and, hence, the detailed description thereof is omitted. It is noted that the reference characters in FIGS. 3A and 3B which indicate the same elements as those shown in FIGS. 2A and 2B include the same final characters but start with "3" instead of "2".

Figure 3B:
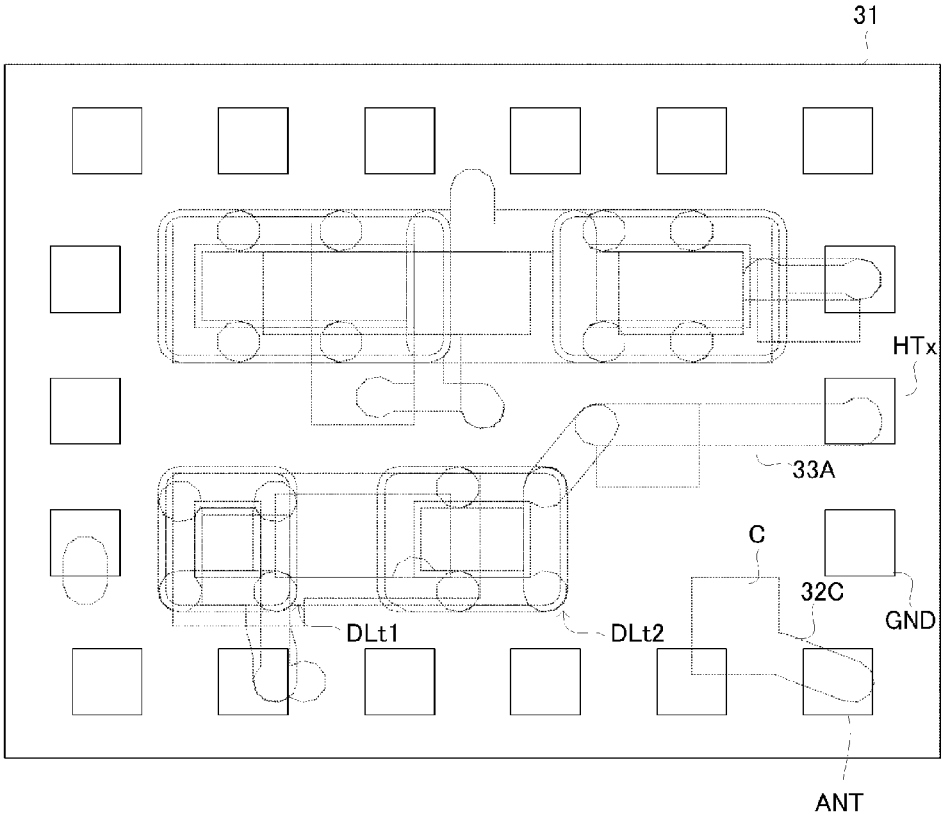
FIG. 3B is a plan view of the mounting surface of the multilayer substrate which defines the switch module according to the third preferred embodiment of the present invention.

FIG. 3B is a plan view of the multilayer substrate 31 viewed from the bottom surface side, illustrated as a mirror image in which left and right are reversed. FIG. 3B illustrates a transparent view of the pattern electrodes on the dielectric layers PL5 to PL14 sandwiched between the inner-layer ground electrodes 34A and 34C.

A wiring portion 33A between the inductor DLt2 and the high-frequency-side transmission signal terminal HTx is preferably a first wiring portion in the present preferred embodiment. The wiring portion 33A, when coupled to a wiring portion 32A, a wiring portion 32C, or the capacitor C connected to the antenna terminal ANT through an electromagnetic field, causes degradation of the isolation characteristics and the filter characteristics.

Hence, in the multilayer substrate 31 in the switch module of the present preferred embodiment, a plurality of via electrodes (not illustrated) connected to the ground terminal GND are arranged between the wiring portion 33A and the wiring portions 32A and 32C and between the wiring portion 33A and the capacitor C, in the transparent plan view of the dielectric layers PL6 to PL16 where the wiring portion 33A is arranged. These via electrodes correspond to a second wiring portion in the present preferred embodiment, and allow the wiring portion 33A to be electromagnetically separated from the common-port-side circuit. Since electromagnetic field coupling between the wiring portion 33A and the common-port-side circuit is reduced, isolation of the common-port-side circuit 104 and the switching-port-side circuit 107B from each other is improved and the attenuation characteristics of the low pass filter defining the switching-port-side circuit 107B are improved.

Fourth Preferred Embodiment

Hereinafter, a switch module according to a fourth preferred embodiment of the present invention will be described.

Note that the circuit configuration of the switch module according to the present preferred embodiment is also preferably the same as that of the front end circuit FEC illustrated in FIG. 5A.

Figure 4A:
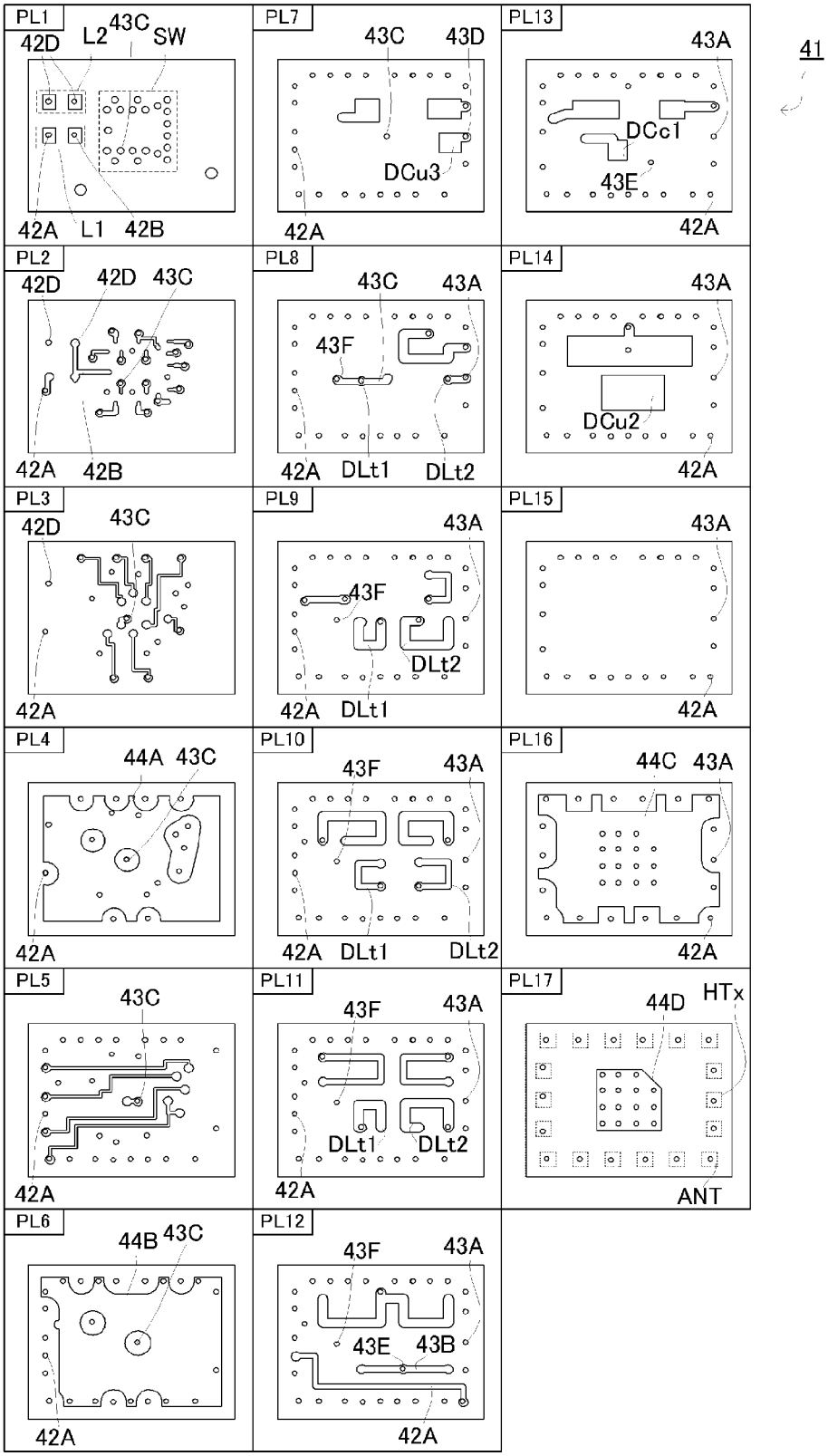
FIG. 4A is a stacking diagram of a multilayer substrate which defines a switch module according to a fourth preferred embodiment of the present invention.

FIG. 4A is a stacking diagram of a multilayer substrate 41 of the switch module according to the fourth preferred embodiment. Note that the multilayer substrate 41 is provided by removing the independent pattern electrode defining a portion of the capacitor from the multilayer substrate 11 described in the first preferred embodiment, moving the pattern electrode of wiring of the wiring portion 12A from the dielectric layer PL10 to the dielectric layer PL12, and defining the capacitor C using this pattern electrode and the inner-layer electrode. As a result of defining the capacitor C using the pattern electrode of wiring and the inner-layer ground electrode, an area of the multilayer substrate 41 occupied by the circuit elements is decreased. The rest of the configuration is the preferably same as that of the multilayer substrate 11 described in the first preferred embodiment and, hence, the detailed description thereof is omitted here. It is noted that the reference characters in FIGS. 4A and 4B which indicate the same elements as those shown in FIGS. 2A and 2B include the same final characters but start with "4" instead of "2".

Figure 4B:
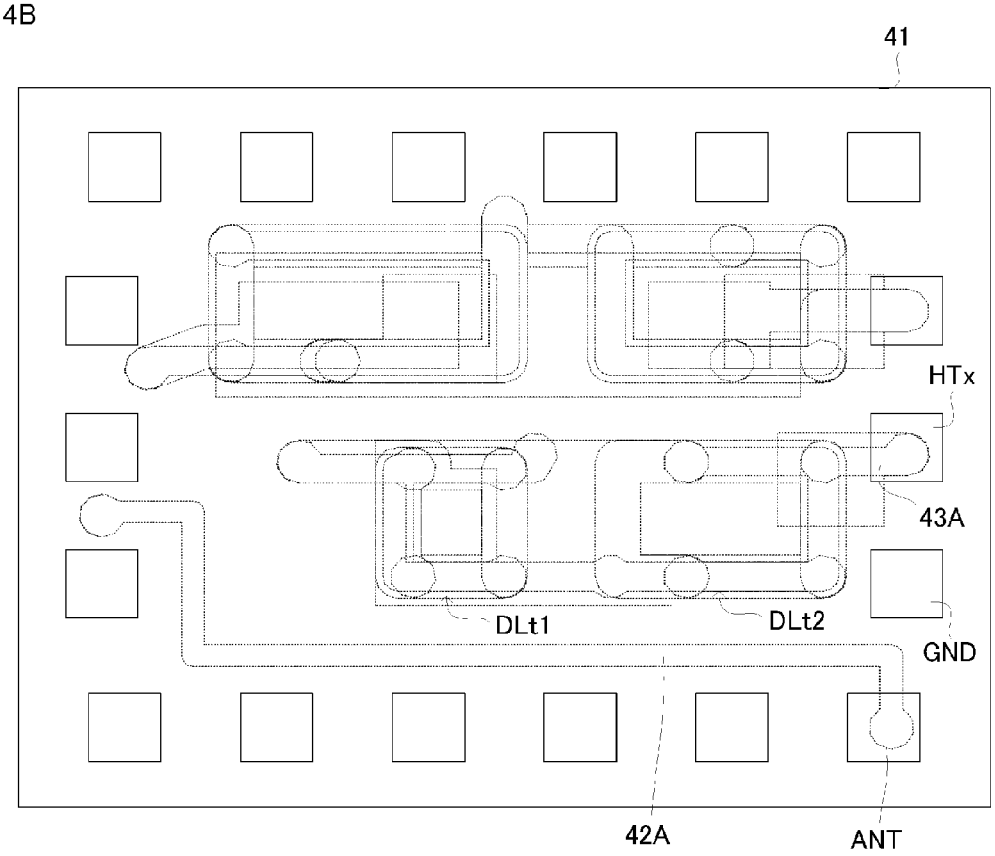
FIG. 4B is a plan view of the mounting surface of the multilayer substrate which defines the switch module according to the fourth preferred embodiment of the present invention.

FIG. 4B is a plan view of the multilayer substrate 41 viewed from the bottom surface side, illustrated as a mirror image in which left and right are reversed. FIG. 4B illustrates a transparent view of the pattern electrodes on the dielectric layers PL7 to PL15 sandwiched between the inner-layer ground electrodes 44B and 44C.

A wiring portion 43A between the inductor DLt2 and the high-frequency-side transmission signal terminal HTx is a first wiring portion in the present preferred embodiment. The wiring portion 43A, when coupled to a wiring portion 42A connected to the antenna terminal ANT through an electromagnetic field, causes degradation of the isolation characteristics and the filter characteristics.

Hence, in the multilayer substrate 41 in the switch module of the present preferred embodiment, via electrodes (not illustrated) connected to the ground terminal GND or the pattern electrodes and via electrodes defining the inductors DLt1 and DLt2 are preferably arranged between the wiring portion 43A and the wiring portion 42A in the transparent plan view of the dielectric layers PL8 to PL17 where the wiring portion 43A is arranged. The via electrodes (not illustrated) connected to the ground terminal GND or the pattern electrodes and via electrodes defining the inductors DLt1 and DLt2 correspond to a second wiring portion in the present preferred embodiment, and allow the wiring portion 43A to be electromagnetically separated from the common-port-side circuit. Since electromagnetic field coupling between the wiring portion 43A and the common-port-side circuit is reduced, isolation of the common-port-side circuit 104 and the switching-port-side circuit 107B from each other is improved and the attenuation characteristics of the low pass filter defining the switching-port-side circuit 107B are improved.

In the multilayer substrate 41, instead of using a chip device as the inductor L1, the parasitic inductance of the pattern electrode which defines a portion of the capacitor C or the via electrode connected to the pattern electrode may be used. In this case, an area occupied by the circuit elements may be further reduced.

The switch module of the present invention can be realized using the configurations described in the preferred embodiments above. Although non-limiting example configurations in which the inductors L1 and L2 are realized using chip devices have been described above, a configuration may be used in which the inductors L1 and L2 are alternatively defined by electrode patterns provided inside the multilayer substrate. Further, the pattern electrode which defines a portion of the capacitor C or the parasitic inductance of the via electrode connected to the pattern electrode may be used as the inductor L1. The specific configuration and the circuit configuration of the switch module are not limited to those described above.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A switch module comprising:

a multilayer substrate including a plurality of dielectric layers and a plurality of electrode layers stacked on each other;

a plurality of external connection terminals arranged on an outer surface of the multilayer substrate;

a switch circuit that includes a common port and a plurality of switching ports and that is arranged to switch the switching ports so that the switching ports become connected to the common port;

a common-port-side circuit connected between the common port and a first external connection terminal among the plurality of the external connection terminals;

a plurality of switching-port-side circuits including a first switching-port-side circuit that includes a filter circuit and that is connected between one of the plurality of the switching ports and a second external connection terminal among the plurality of the external connection terminals;

a first wiring portion that connects the filter circuit to the second external connection terminal;

a second wiring portion that is arranged between the first wiring portion and the common-port-side circuit when the multilayer substrate is viewed in plan and that reduces electromagnetic field coupling between the first wiring portion and the common-port-side circuit; and the first wiring portion is directly connected to the second wiring portion.

2. The switch module according to claim 1, wherein the second wiring portion includes a pattern electrode and a via electrode defining, together with the first wiring portion, the first switching-port-side circuit.

3. The switch module according to claim 1, wherein the second wiring portion includes a pattern electrode and a via electrode connected to a ground potential.

4. The switch module according to claim 1, wherein the common-port-side circuit includes a capacitor connected to the first external connection terminal as a shunt, a first inductor connected in series with the first external connection terminal, and a second inductor connected to the first inductor as a shunt.

5. The switch module according to claim 4, wherein the common-port-side circuit includes a pattern electrode that is arranged between the common port and the first external connection terminal so as to face a ground electrode and that defines a portion of the capacitor.

6. The switch module according to claim 4, further comprising a non-grounded pattern electrode that faces a ground electrode arranged on an inner layer of the multilayer substrate and that defines a portion of the capacitor.

7. The switch module according to claim 6, wherein the pattern electrode defining a portion of the capacitor is arranged on a dielectric layer different from a dielectric layer on which the filter circuit is arranged.

8. The switch module according to claim 6, wherein the pattern electrode defining a portion of the capacitor is surrounded by via electrodes connected to a ground potential.

9. The switch module according to claim 6, wherein ground electrodes are arranged on both sides, in a stacking direction of the multilayer substrate, of the pattern electrode defining a portion of the capacitor.

10. The switch module according to claim 4, wherein the common-port-side circuit includes a pattern electrode defining the first inductor, between the common port and the first external connection terminal.

11. The switch module according to claim 6, wherein the ground electrode is connected to ground and is arranged only to define a portion of the capacitor.

12. The switch module according to claim 1, wherein a pattern electrode of the first wiring portion is provided on a dielectric layer which is different from a dielectric layer of the plurality of dielectric layers on which a pattern electrode of the second wiring portion is provided and from a dielectric layer of the plurality of dielectric layers on which a pattern electrode of the common-port circuit is provided.

13. A switch module comprising:

a multilayer substrate including a plurality of dielectric layers and a plurality of electrode layers stacked on each other;

a plurality of external connection terminals arranged on an outer surface of the multilayer substrate;

a switch circuit that includes a common port and a plurality of switching ports and is arranged to switch the switching ports so that the switching ports become connected to the common port;

a common-port-side circuit connected between the common port and a first external connection terminal among the plurality of the external connection terminals;

a plurality of switching-port-side circuits including a filter circuit that is connected between one of the plurality of the switching ports and a second external connection terminal among the plurality of the external connection terminals;

a first wiring portion that connects the filter circuit to the second external connection terminal;

a second wiring portion that is arranged between the first wiring portion and the common-port-side circuit when the multilayer substrate is viewed in plan and that reduces electromagnetic field coupling between the first wiring portion and the common-port-side circuit; and the first wiring portion is directly connected to the second wiring portion.

14. The switch module according to claim 13, wherein the second wiring portion includes a pattern electrode and a via electrode defining, together with the first wiring portion, a first switching-port-side circuit which includes the filter circuit.

15. The switch module according to claim 13, wherein the second wiring portion includes a pattern electrode and a via electrode connected to a ground potential.

16. The switch module according to claim 13, wherein the common-port-side circuit includes a capacitor connected to the first external connection terminal as a shunt, a first inductor connected in series with the first external connection terminal, and a second inductor connected to the first inductor as a shunt.

17. The switch module according to claim 16, wherein the common-port-side circuit includes a pattern electrode that is arranged between the common port and the first external connection terminal so as to face a ground electrode and that defines a portion of the capacitor.

18. The switch module according to claim 16, further comprising a non-grounded pattern electrode that faces a ground electrode arranged on an inner layer of the multilayer substrate and that defines a portion of the capacitor.

19. The switch module according to claim 18, wherein the pattern electrode defining the portion of the capacitor is arranged on a dielectric layer different from a dielectric layer on which the filter circuit is arranged.

20. The switch module according to claim 18, wherein the pattern electrode defining the portion of the capacitor is surrounded by via electrodes connected to a ground potential.

21. The switch module according to claim 18, wherein ground electrodes are arranged on both sides, in a stacking direction of the multilayer substrate, of the pattern electrode defining the portion of the capacitor.

22. The switch module according to claim 16, wherein the common-port-side circuit includes a pattern electrode defining the first inductor, between the common port and the first external connection terminal.

* * * * *